US011468835B2

(12) United States Patent
Ma

(10) Patent No.: US 11,468,835 B2
(45) Date of Patent: Oct. 11, 2022

(54) PIXEL CIRCUIT AND DRIVING METHOD THEREOF, AND DISPLAY DEVICE

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventor: Guoqiang Ma, Beijing (CN)

(73) Assignees: CHENGDU BOE OPTOELECTRONICS TECHNOLOGY CO., LTD., Sichuan (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 720 days.

(21) Appl. No.: 16/335,853

(22) PCT Filed: Aug. 8, 2018

(86) PCT No.: PCT/CN2018/099416
§ 371 (c)(1),
(2) Date: Mar. 22, 2019

(87) PCT Pub. No.: WO2019/109657
PCT Pub. Date: Jun. 13, 2019

(65) Prior Publication Data

US 2021/0366383 A1 Nov. 25, 2021

(30) Foreign Application Priority Data

Dec. 4, 2017 (CN) ..... 201711262402.9

(51) Int. Cl.
*G09G 3/32* (2016.01)
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 2300/0426; G09G 2300/0819; G09G 2300/0852;
(Continued)

(56) References Cited

U.S. PATENT DOCUMENTS 9,349,324 B2 5/2016 Chang et al.
10,262,592 B2 4/2019 Kang et al.
(Continued)

FOREIGN PATENT DOCUMENTS

CN 103150992 A 6/2013
CN 104050923 A 9/2014
(Continued)

OTHER PUBLICATIONS

First Chinese Office Action from Chinese Patent Application No. 201711262402.9 dated Aug. 27, 2020.
Chinese Office Action dated Mar. 2, 2020.

*Primary Examiner* — Towfiq Elahi
(74) *Attorney, Agent, or Firm* — Dilworth & Barrese, LLP.; Michael J. Musella, Esq.

(57) ABSTRACT

A pixel circuit and a driving method thereof, and a display device are provided. The pixel circuit includes a data writing circuit, a driving circuit, a first compensation circuit, a second compensation circuit and a light emitting element. The driving circuit includes a control terminal, a first terminal and a second terminal, and is configured to control a driving current which runs through the first terminal and the second terminal and is used to drive the light emitting element to emit light; the data writing circuit is connected with the control terminal of the driving circuit, and is configured to write a data signal or a reference voltage signal to the control terminal of the driving circuit in response to a scan signal.

19 Claims, 10 Drawing Sheets

(52) U.S. Cl.
CPC ..... *G09G 2300/0852* (2013.01); *G09G 2310/0202* (2013.01); *G09G 2320/0233* (2013.01); *G09G 2320/045* (2013.01)

(58) Field of Classification Search
CPC ... G09G 2310/0202; G09G 2320/0233; G09G 2320/045
See application file for complete search history.

(56) References Cited

U.S. PATENT DOCUMENTS

| | | | | |
|---|---|---|---|---|
| 10,297,202 | B2 * | 5/2019 | Xiang | G09G 3/3258 |
| 2008/0252217 | A1 * | 10/2008 | Kim | G09G 3/3233 315/51 |
| 2015/0187281 | A1 * | 7/2015 | Lee | G09G 3/3258 345/212 |
| 2018/0197474 | A1 * | 7/2018 | Jeon | H01L 27/1255 |
| 2019/0384445 | A1 * | 12/2019 | Huang | G09G 3/325 |

FOREIGN PATENT DOCUMENTS

| | | | |
|---|---|---|---|
| CN | 104832211 | A | 12/2014 |
| CN | 105789250 | A | 7/2016 |
| CN | 105825815 | A | 8/2016 |
| CN | 106448560 | A | 2/2017 |
| CN | 106910458 | A | 6/2017 |
| KR | 1020120078416 | A | 7/2012 |

* cited by examiner

PIXEL CIRCUIT AND DRIVING METHOD THEREOF, AND DISPLAY DEVICE

The present application claims priority to Chinese patent application No. 201711262402.9, filed on Dec. 4, 2017, the entire disclosure of which is incorporated herein by reference as part of the present application.

TECHNICAL FIELD

Embodiments of the present disclosure relate to a pixel circuit and a driving method thereof and a display device.

BACKGROUND

An organic light emitting diode (OLED) display device is gradually attracting attention of people because of advantages such as wide view angle, high contrast, rapid response and higher luminance and lower driving voltage compared to an inorganic light emitting display device. Due to the above characteristics, the organic light emitting diode can be applied in a device having a display function such as a cellphone, a display, a notebook, a digital camera, instrument and apparatus and the like.

A pixel circuit of the OLED display device usually adopts a matrix driving manner, and the matrix driving manner is categorized as an active matrix (AM) driving and a passive matrix (PM) driving according to whether a switch element is in each pixel unit. PMOLED is of simple process and low cost, but cannot satisfy requirements of high-resolution and large-size display due to disadvantages such as crosstalk, high consumption and short lifetime. In contrast, AMOLED integrates a set of thin film transistor and storage capacitor in the pixel circuit of each pixel, and realizes a control over a current running through the OLED by controlling a driving of the thin film transistor and the storage capacitor, so as to enable the OLED to emit light according to needs. Compared to PMOLED, AMOLED needs a smaller driving current and has lower consumption and a longer lifetime, so as to be able to satisfy requirements of high-resolution, multiple-grayscale and large-size display. Meanwhile, AMOLED has obvious advantages in respects such as visible angle, color rendition, consumption and response time, and is applicable in a high-information content and high-resolution display device.

SUMMARY

At least an embodiment of the present disclosure provides a pixel circuit, comprising a data writing circuit, a driving circuit, a first compensation circuit, a second compensation circuit and a light emitting element. The driving circuit comprises a control terminal, a first terminal and a second terminal, and is configured to control a driving current which runs through the first terminal and the second terminal and is used to drive the light emitting element to emit light. The data writing circuit is connected with the control terminal of the driving circuit, and is configured to write a data signal or a reference voltage signal to the control terminal of the driving circuit in response to a scan signal. The first compensation circuit is connected with the control terminal of the driving circuit and the second terminal of the driving circuit, and is configured to store the data signal that is written in and to compensate the driving circuit. The second compensation circuit is connected with a scan signal terminal and the second terminal of the driving circuit, and is configured to adjust, by coupling, a voltage of the second terminal of the driving circuit according to a voltage variation value at the control terminal of the driving circuit.

For example, in a pixel circuit provided by an embodiment of the present disclosure, the control terminal of the driving circuit is connected with a first node, and the second terminal of the driving circuit is connected with a second node; the data writing circuit is connected with the scan signal terminal, a data signal terminal and the first node; and the light emitting element is connected with the second node and a first voltage terminal.

For example, a pixel circuit provided by an embodiment of the present disclosure further comprises a reset circuit. The reset circuit is connected with a reset control terminal, a reset voltage terminal and the second node, and is configured to apply a reset voltage to the second node in response to a reset signal.

For example, a pixel circuit provided by an embodiment of the present disclosure further comprises a first light emission control circuit. The first light emission control circuit is connected with a second voltage terminal, a first light emission control terminal and the first terminal of the driving circuit, and is configured to apply a second voltage to the first terminal of the driving circuit in response to a first light emission control signal.

For example, a pixel circuit provided by an embodiment of the present disclosure further comprises a second light emission control circuit. The second light emission control circuit is connected with a second light emission control terminal, the second node and the light emitting element, and is configured to apply the driving current to the light emitting element in response to a second light emission control signal.

For example, in a pixel circuit provided by an embodiment of the present disclosure, the driving circuit comprises a first transistor. A gate electrode of the first transistor functions as the control terminal of the driving circuit and is connected with the first node, a first electrode of the first transistor functions as the first terminal of the driving circuit and is connected with a third node, and a second electrode of the first transistor functions as the second terminal of the driving circuit and is connected with the second node.

For example, in a pixel circuit provided by an embodiment of the present disclosure, the data writing circuit comprises a second transistor. A gate electrode of the second transistor is configured to be connected with the scan signal terminal so as to receive the scan signal, a first electrode of the second transistor is configured to be connected with the data signal terminal so as to receive the data signal, and a second electrode of the second transistor is connected with the first node.

For example, in a pixel circuit provided by an embodiment of the present disclosure, the first compensation circuit comprises a first storage capacitor. A first electrode of the first storage capacitor is connected with the first node, and a second electrode of the first storage capacitor is connected with the second node.

For example, in a pixel circuit provided by an embodiment of the present disclosure, the second compensation circuit comprises a second storage capacitor. A first electrode of the second storage capacitor is connected with the scan signal terminal, and a second electrode of the second storage capacitor is connected with the second node.

For example, in a pixel circuit provided by an embodiment of the present disclosure, the reset circuit comprises a third transistor. A gate electrode of the third transistor is configured to be connected with the reset control terminal so as to receive the reset signal, a first electrode of the third transistor is connected with the second node, and a second electrode of the third transistor is configured to be connected with the reset voltage terminal so as to receive the reset voltage.

The first light emission control circuit comprises a fourth transistor. A gate electrode of the fourth transistor is configured to be connected with the first light emission control terminal so as to receive the first light emission control signal, a first electrode of the fourth transistor is configured to be connected with the second voltage terminal so as to receive the second voltage, and a second electrode of the fourth transistor is connected with the first terminal of the driving circuit.

For example, in a pixel circuit provided by an embodiment of the present disclosure, the second light emission control circuit comprises a fifth transistor. A gate electrode of the fifth transistor is configured to be connected with the second light emission control terminal so as to receive the second light emission control signal, a first electrode of the fifth transistor is connected with the second node, and a second electrode of the fifth transistor is connected with the light emitting element.

At least an embodiment of the present disclosure further provides a display device, comprising a plurality of pixel units arranged in an array. Each of the plurality of pixel units comprises the pixel circuit provided by the embodiment of the present disclosure.

For example, a display device provided by an embodiment of the present disclosure further comprises a plurality of scan signal lines and a plurality of data signal lines. A scan signal line at each row is connected with the data writing circuit and the second compensation circuit of the pixel circuit at the each row so as to provide the scan signal; and a data signal line at each column is connected with the data writing circuit of the pixel circuit at the each column so as to provide the data signal or the reference voltage signal.

For example, a display device provided by an embodiment of the present disclosure further comprises a plurality of reset control lines. The pixel circuit further comprises a reset circuit, and the reset circuit is connected with a reset control terminal, a reset voltage terminal and the second terminal of the driving circuit, and is configured to apply a reset voltage to the second terminal of the driving circuit in response to a reset signal; and a reset control line at each row is connected with the reset circuit of the pixel circuit at the each row so as to provide the reset signal.

For example, a display device provided by an embodiment of the present disclosure further comprises a plurality of first light emission control lines. The pixel circuit further comprises a first light emission control circuit, and the first light emission control circuit is connected with a second voltage terminal, a first light emission control terminal and the first terminal of the driving circuit, and is configured to apply a second voltage to the first terminal of the driving circuit in response to a first light emission control signal; and a first light emission control line at each row is connected with the first light emission control circuit of the pixel circuit at the each row so as to provide the first light emission control signal.

For example, a display device provided by an embodiment of the present disclosure further comprises a plurality of second light emission control lines. The pixel circuit further comprises a second light emission control circuit, and the second light emission control circuit is connected with a second light emission control terminal, the second node and the light emitting element, and is configured to apply the driving current to the light emitting element in response to a second light emission control signal; and a second light emission control line at each row is connected with the second light emission control circuit of the pixel circuit at the each row so as to provide the second light emission control signal.

At least an embodiment of the present disclosure further provides a driving method of a pixel circuit, comprising a compensation stage and a data writing stage. During the compensation stage, inputting the scan signal, turning on the data writing circuit and the driving circuit, and allowing the first compensation circuit to compensate the driving circuit; and during the data writing stage, inputting the scan signal and the data signal, turning on the data writing circuit, allowing the data writing circuit to write the data signal to the first compensation circuit, and allowing the second compensation circuit to adjust, by coupling, the voltage of the second terminal of the driving circuit according to the voltage variation value at the control terminal of the driving circuit.

At least an embodiment of the present disclosure further provides a driving method of a pixel circuit, comprising a reset stage, a compensation stage, a data writing stage and a light emitting stage. During the reset stage, inputting the reset signal and the scan signal, turning on the reset circuit and the data writing circuit, and resetting the first compensation circuit, the second compensation circuit and the light emitting element; during the compensation stage, inputting the scan signal and the first light emission control signal, turning on the data writing circuit, the first light emission control circuit and the driving circuit, and allowing the first compensation circuit to compensate the driving circuit; during the data writing stage, inputting the scan signal and the data signal, turning on the data writing circuit, allowing the data writing circuit to write the data signal to the first compensation circuit, and allowing the second compensation circuit to adjust, by coupling, a voltage of the second node according to a voltage variation value at the first node; and during the light emitting stage, inputting the first light emission control signal and the second light emission control signal, turning on the first light emission control circuit, the second light emission control circuit and the driving circuit, allowing the second compensation circuit to adjust, by coupling, the voltage of the second node according to the voltage variation value at the first node, allowing the first light emission control circuit to apply the second voltage to the first terminal of the driving circuit, and allowing the second light emission control circuit to apply the driving current to the light emitting element so as to enable the light emitting element to emit light.

BRIEF DESCRIPTION OF THE DRAWINGS

In order to clearly illustrate technical solutions of the embodiments of the disclosure, the accompanying drawings of the embodiments will be briefly described in the following. It is obvious that the drawings may only relate to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1A:
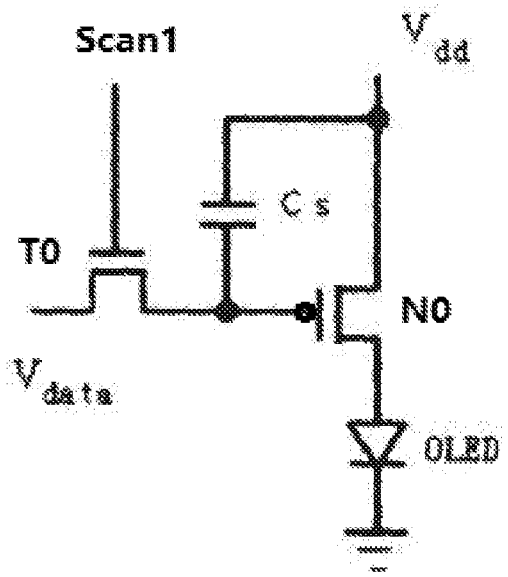
FIG. 1A is a schematic diagram of a 2T1C pixel circuit.
Figure 1B:
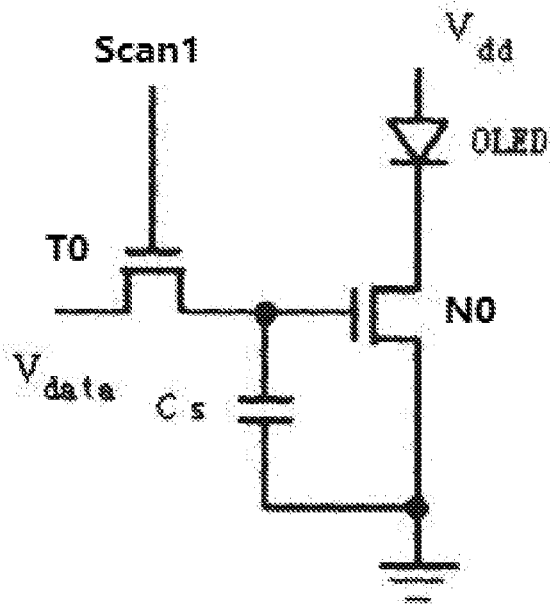
FIG. 1B is a schematic diagram of another 2T1C pixel circuit.

A basic pixel circuit used in an AMOLED display device is usually a 2T1C pixel circuit, that is, two thin film transistors (TFT) and one storage capacitor are used to realize a basic function of driving the OLED to emit light. FIG. 1A and FIG. 1B respectively illustrate schematic diagrams of two types of 2T1C pixel circuits.

As illustrated in FIG. 1A, a type of 2T1C pixel circuit includes a switch transistor T0, a driving transistor N0 and a storage capacitor Cs. For example, a gate electrode of the switch transistor T0 is connected with a gate line to receive a scan signal Scan1, for example, a source electrode of the switch transistor T0 is connected with a data line to receive a data signal Vdata, and a drain electrode of the switch transistor T0 is connected with a gate electrode of the driving transistor N0. A source electrode of the driving transistor N0 is connected with a first voltage terminal to receive a first voltage Vdd (a high voltage), and a drain electrode of the driving transistor N0 is connected with the anode of the OLED. One terminal of the storage capacitor Cs is connected with the drain electrode of the switch transistor T0 and the gate electrode of the driving transistor N0, and the other terminal of the storage capacitor Cs is connected with the source electrode of the driving transistor N0 and the first voltage terminal. The cathode of the OLED is connected with a second voltage terminal to receive a second voltage Vss (a low voltage, a grounded voltage for example). A driving manner of the 2T1C pixel circuit is to control bright and dark (a greyscale) of a pixel by the two TFTs and the storage capacitor Cs. When the scan signal Scan1 is applied by the gate line to turn on the switch transistor T0, the data signal (Vdata) which is inputted through the data line by a data driving circuit charges the storage capacitor Cs through the switch transistor T0, so as to store the data signal in the storage capacitor Cs. The data signal that is stored controls a conduction degree of the driving transistor N0 so as to control a value of a current which runs through the driving transistor N0 to drive the OLED to emit light; that is, the current determines an emission greyscale of the pixel. In the 2T1C pixel circuit as illustrated in FIG. 1A, the switch transistor T0 is an n-type transistor, and the driving transistor NO is a p-type transistor.

As illustrated in FIG. 1B, another type of 2T1C pixel circuit also includes a switch transistor T0, a driving transistor N0 and a storage capacitor Cs, but the connection manner is slightly different, and the driving transistor N0 is an n-type transistor. Difference of the pixel circuit of FIG. 1B compared to the pixel circuit of FIG. 1A includes: the anode of the OLED is connected with the first voltage terminal to receive the first voltage Vdd (a high voltage), the cathode of the OLED is connected with the drain electrode of the driving transistor N0, and the source electrode of the driving electrode N0 is connected with the second voltage terminal to receive the second voltage Vss (a low voltage, a grounded voltage for example). One terminal of the storage capacitor Cs is connected with the drain electrode of the switch transistor T0 and the gate electrode of the driving transistor N0, and the other terminal of the storage capacitor Cs is connected with the source electrode of the driving transistor N0 and the second voltage terminal. The operation manner of the 2T1C pixel circuit is substantially same as the pixel circuit as illustrated in FIG. 1A, which is not repeated here.

Additionally, for the pixel circuits as illustrated in FIG. 1A and FIG. 1B, the switch transistor T0 is not limited to an n-type transistor and may also be a p-type transistor, and a polarity of the scan signal Scan1 controlling the switch transistor T0 to turn on or turn off is accordingly changed.

An OLED display device usually includes a plurality of pixel units arranged in an array, and each pixel circuit may include the above-mentioned pixel circuit for example. In the OLED display device, a threshold voltage of the driving transistor of each pixel circuit may vary due to a manufacturing process, and the threshold voltage of the driving transistor may drift as a variation of working time, a variation of temperature for example. Difference in threshold voltages of thin film transistors may cause poor display (e.g., display mura). As a result, the threshold voltage of the thin film transistor needs to be compensated.

Industry provides a pixel circuit having a compensation function based on the above basic 2T1C pixel circuit, and the compensation function may be realized through a voltage compensation, a current compensation or a hybrid compensation. The pixel circuit having the compensation function may adopt a 4T1C or 4T2C structure for example, which is not described in detail here.

At least an embodiment of the present disclosure provides a pixel circuit, and the pixel circuit includes a data writing circuit, a driving circuit, a first compensation circuit, a second compensation circuit and a light emitting element. The driving circuit includes a control terminal, a first terminal and a second terminal, and is configured to control a driving current which runs through the first terminal and the second terminal, and is used to drive the light emitting element to emit light. The data writing circuit is connected with the control terminal of the driving circuit, and is configured to write a data signal or a reference voltage signal to the control terminal of the driving circuit in response to a scan signal. The first compensation circuit is connected with the control terminal of the driving circuit and the second terminal of the driving circuit, and is configured to store the data signal that is written in and to compensate the driving circuit. The second compensation circuit is connected with a scan signal terminal and the second terminal of the driving circuit, and is configured to adjust, by coupling, a voltage of the second terminal of the driving circuit according to a voltage variation value at the control terminal of the driving circuit. At least an embodiment of the present disclosure further provides a driving method and a display device corresponding to the above pixel circuit.

The pixel circuit and the driving method thereof and the display device provided by the embodiments of the present disclosure can compensate the threshold voltage of the driving transistor of the pixel circuit and avoid display mura, so that a display effect of the display device adopting the pixel circuit can be improved.

Embodiments of the present disclosure and examples thereof are described in detail below in combination with the accompanying drawings.

Figure 2:
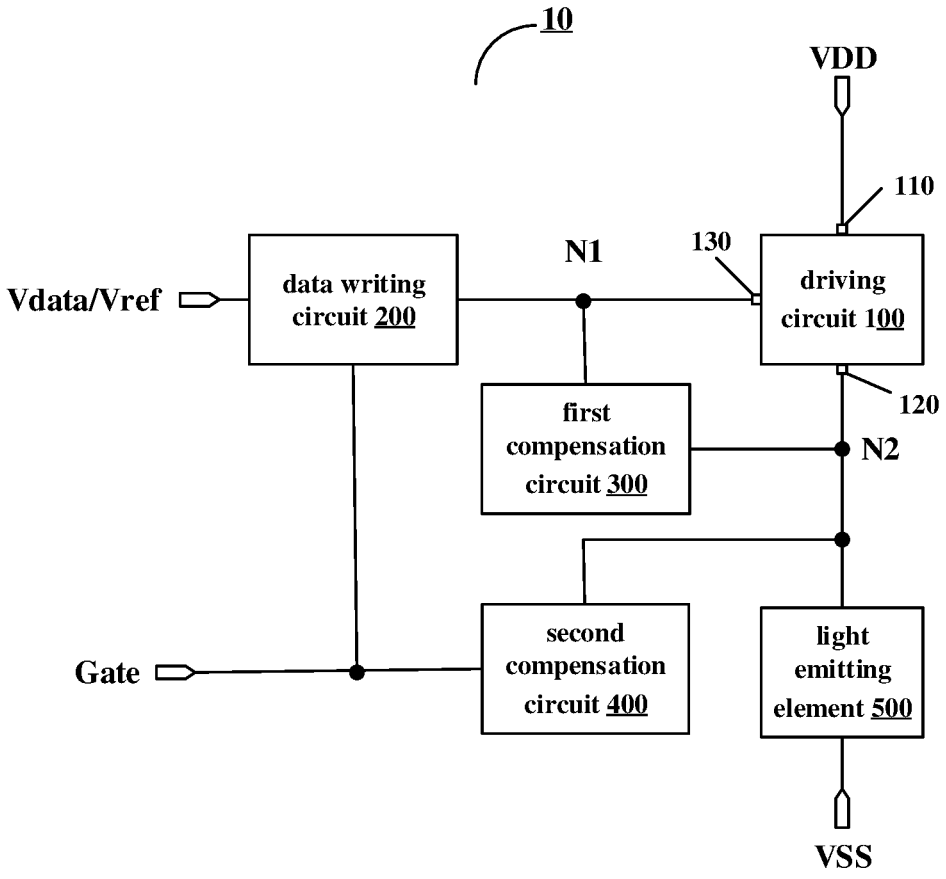
FIG. 2 is a schematic block diagram of a pixel circuit provided by an embodiment of the present disclosure.

An embodiment of the present disclosure provides a pixel circuit 10, and the pixel circuit 10 is applied in a sub-pixel of an OLED display device for example. As illustrated in FIG. 2, the pixel circuit 10 includes a driving circuit 100, a data writing circuit 200, a first compensation circuit 300, a second compensation circuit 400 and a light emitting element 500.

For example, the driving circuit 100 includes a first terminal 110, a second terminal 120 and a control terminal 130, and the driving circuit 100 is configured to control a driving current which runs through the first terminal 110 and the second terminal 120, and the driving current is configured to drive the light emitting element 500 to emit light. The control terminal 130 of the driving circuit 100 is connected with a first node N1, and the second terminal 120 of the driving circuit 100 is connected with a second node N2. For example, during a light emitting stage, the driving circuit 100 can provide the driving current to the light emitting element 500 to drive the light emitting element 500 to emit light and to emit light according to a grayscale that is needed.

Figure 3:
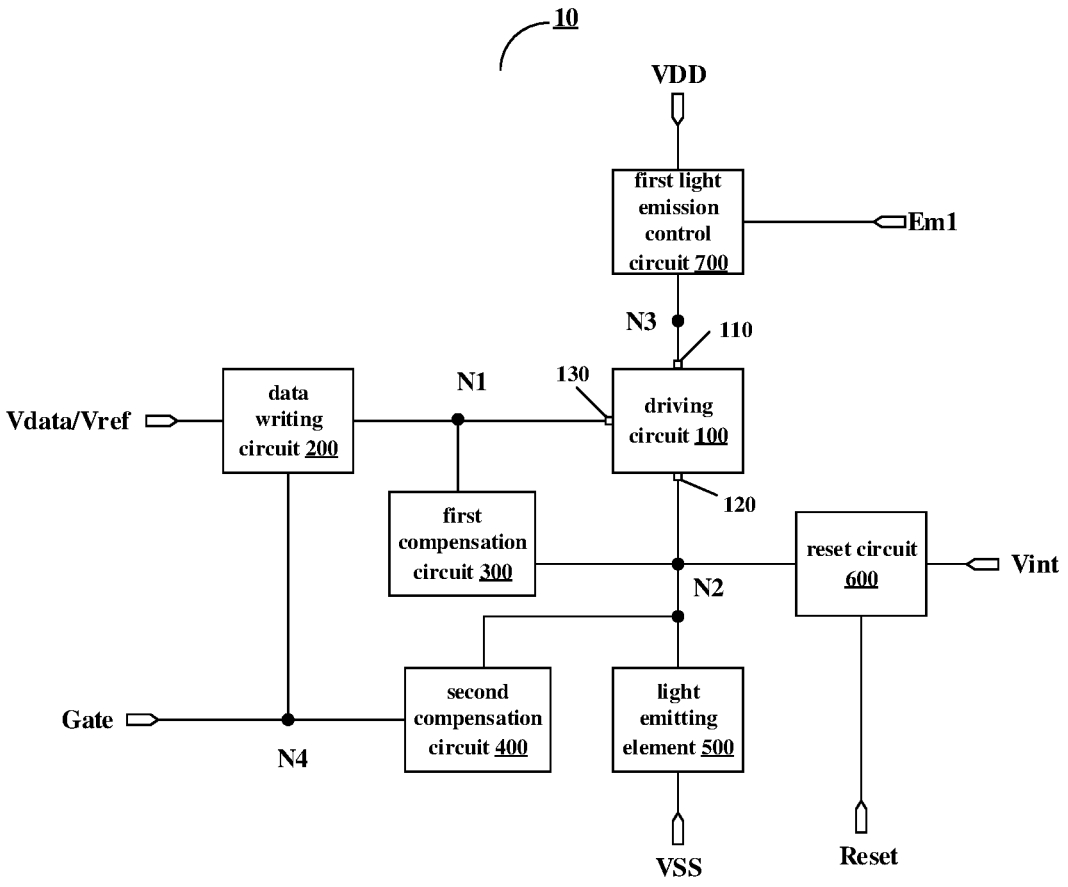
FIG. 3 is a schematic block diagram of another pixel circuit provided by an embodiment of the present disclosure.
Figure 4:
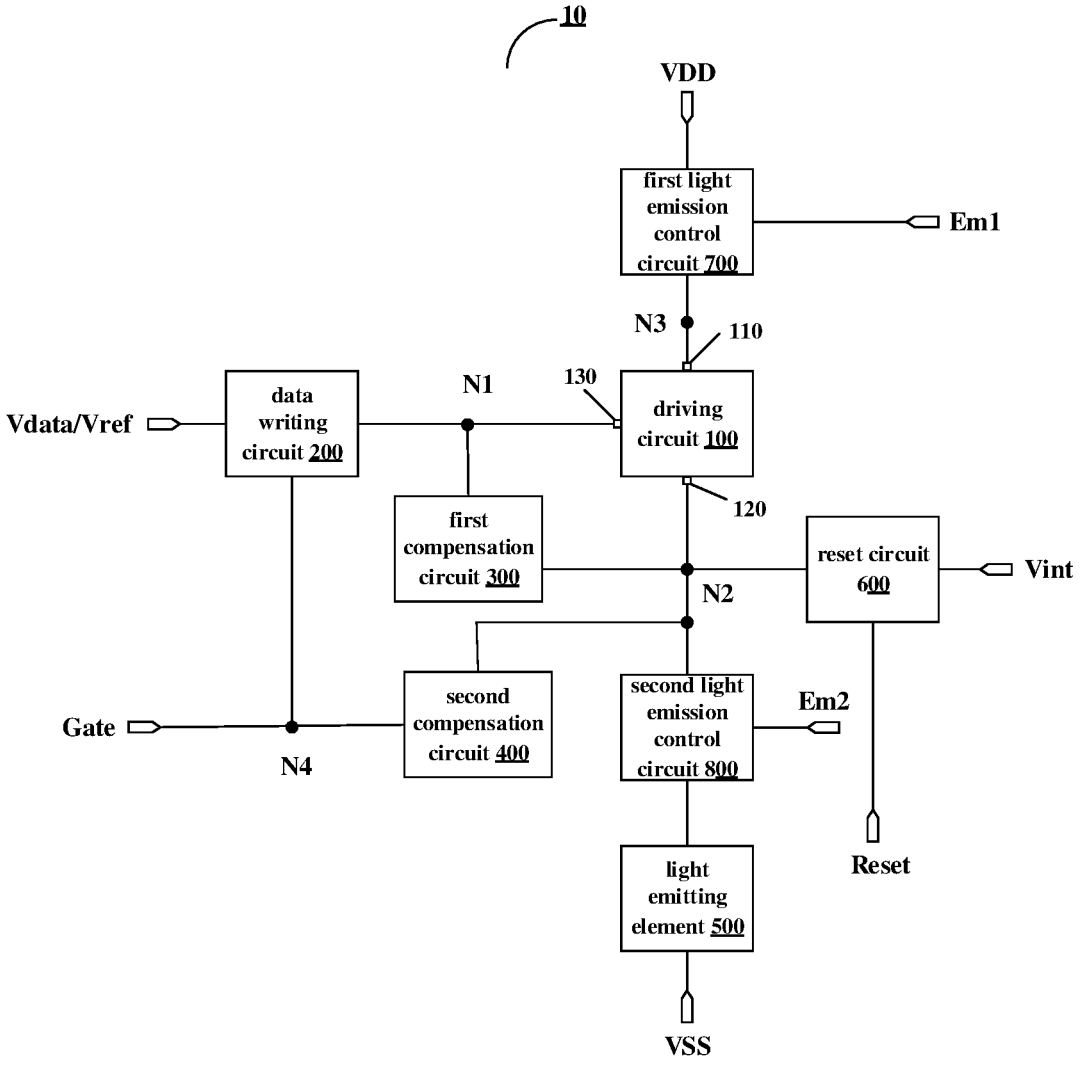
FIG. 4 is a schematic block diagram of still another pixel circuit provided by an embodiment of the present disclosure.

For example, the light emitting element 500 may adopt an OLED, and is configured to be connected with the second node N2 and a first voltage terminal VSS. It should be noted that in some embodiments of the present disclosure, as illustrated in FIG. 2 and FIG. 3 for example, the light emitting element 500 is directly connected with the second node N2. For example, in some embodiments of the present disclosure, as illustrated in FIG. 4, in a condition that the pixel circuit 10 includes a second light emission control circuit 800, the light emitting element 500 may be connected with the second node N2 through the second light emission control circuit 800, which is not limited to the present disclosure.

For example, the data writing circuit 200 is connected with a scan signal terminal (a scan signal line) Gate, a data signal terminal (a data signal line) Vdata/Vref and the first node N1 (i.e. the control terminal 130 of the driving circuit 100), and is configured to write the data signal Vdata or the reference voltage signal Vref to the control terminal 130 of the driving circuit 100 in response to a scan signal.

For example, during a rest stage and a compensation stage, the data writing circuit 200 may be turned on in response to the scan signal, so as to write the reference voltage signal Vref to the control terminal 130 (i.e. the first node N1) of the driving circuit 100. For another example, during a data writing stage, the data writing circuit 200 may be turned on in response to the scan signal, so as to write the data signal Vdata to the control terminal 130 (i.e. the first node N1) of the driving circuit 100 and store the data signal Vdata in the first compensation circuit 300, so as to generate a driving current for driving the light emitting element 500 to emit light according to the data signal Vdata in a light emitting stage for example, which may be referred to below descriptions for example.

For example, in some examples, a level of the data signal Vdata may be 3.5V-4.5V, and a level of the reference voltage signal Vref may be 3V, which is included by but not limited to the embodiments of the present disclosure.

It should be noted that in descriptions about the embodiments of the present disclosure, the symbol Vdata can indicate a data signal as well as a level of the data signal; similarly, the symbol Vref can indicate a reference voltage signal as well as a level of the reference voltage signal. Cases in the below embodiments are same and are not repeated.

For example, the first compensation circuit 300 is connected with the control terminal 130 of the driving circuit 100 and the second terminal 120 of the driving circuit 100, and is configured to store the data signal Vdata that is written in during the data writing stage for example, and to compensate the driving circuit 100. For example, in a condition that the first compensation circuit 300 includes a storage capacitor, during the compensation stage, the first compensation circuit 300 can store information relative to a threshold voltage of the driving circuit 100 accordingly in the storage capacitor. For example, during the data writing stage, the first compensation circuit 300 may be turned on in response the scan signal, so as to store the data signal, which is written in by the data writing circuit 200, in the storage capacitor, so as to use the stored voltages including the data signal Vdata and the threshold voltage to control the driving circuit 100 during the light emitting stage and to allow the driving circuit 100 to be compensated, which may be referred to below descriptions for example.

For example, the second compensation circuit 400 is connected with a scan signal terminal Gate and the second terminal 120 (i.e. the second node N2) of the driving circuit 100, and is configured to adjust, by coupling, a voltage of the second terminal 120 of the driving circuit 100 according to a voltage variation value at the control terminal 130 of the driving circuit 100. For example, in a condition that the second compensation circuit 400 includes a storage capacitor, during the data writing stage and the light emitting stage, when a voltage of the control terminal 130 (i.e. the first node N1) of the driving circuit 100 varies, according to a property of the storage capacitor itself, the second compensation circuit 400 can adjust, by coupling, the voltage of the second terminal 120 (i.e. the second node N2) of the driving circuit 100 according to a voltage variation value at the first node N1, so as to adjust a value of the driving current which is configured to drive the light emitting element 500 to emit light during the light emitting stage. This may be referred to below descriptions for example.

The pixel circuit 10 provided by the embodiment of the present disclosure can compensate the threshold voltage of the driving circuit 100 and prevent the driving current which driving the light emitting element 500 from being influenced by the threshold voltage, so that the display effect of the display device adopting the pixel circuit is improved and the lifetime of the light emitting element 500 is elongated.

For example, as illustrated in FIG. 3, in another example of the embodiment, the pixel circuit 10 may further include a reset circuit 600 and a first light emission control circuit 700.

For example, the reset circuit 600 is connected with a reset control terminal (a reset control line) Reset, a reset voltage terminal (a reset voltage line) Vint and the second node N2, and is configured to apply a reset voltage to the second node N2 in response to a reset signal. For example, during the reset stage, the reset circuit 600 may be turned on in response to the reset signal to apply the reset voltage to the second node N2, so as to perform a reset operation to the first compensation circuit 300, the second compensation circuit 400 and the light emitting element 500 and to eliminate an influence of a previous light emitting stage. For example, in some examples, the reset voltage may be about −3V, which is included by but not limited to the embodiments of the present disclosure.

For example, the first light emission control circuit 700 is connected with a second voltage terminal VDD, a first light emission control terminal (a first light emission control line) Em1 and the first terminal 110 of the driving circuit 100, and is configured to apply a second voltage to the first terminal 110 of the driving circuit 100 in response to a first light emission control signal.

For example, during the light emitting stage, the first light emission control circuit 700 is turned on in response to the first light emission control signal provided by the first light emission control terminal Em1, so as to apply the second voltage provided by the second voltage terminal VDD to the first terminal 110 of the driving circuit 100. Meanwhile, in a condition that the driving circuit 100 is conductive, the driving circuit 100 may apply the second voltage to the light emitting element 500 to provide a driving voltage so as to drive the light emitting element 500 to emit light. For another example, in some examples, during the compensation stage (e. g. before the light emitting stage), the first light emission control circuit 700 may be turned on in response to the first light emission control signal, so that the second node N2 may be charged by the second voltage through the driving circuit 100 and the threshold voltage of the driving circuit 100 is compensated.

For example, as illustrated in FIG. 4, in another example of the embodiment, the pixel circuit 10 further includes a second light emission control circuit 800. The second light emission control circuit 800 is connected with a second light emission control terminal (a first light emission control line) Em2, the second node N2 and the light emitting element 500, and is configured to apply the driving current to the light emitting element 500 in response to a second light emission control signal. For example, during the reset stage, the second light emission control circuit 800 may be turned on in response to the second light emission control signal, so that the reset voltage provided by the reset circuit 600 can be applied to the light emitting element 500 through the second light emission control circuit 800 and a reset operation can be performed to the light emitting element 500 to eliminate an influence of a previous light emitting stage. For another example, during the light emitting stage, the second light emission control circuit 800 may be turned on in response to the second light emission control signal, so that the driving current can be transmitted to the light emitting element 500 through the second light emission control circuit 800 to enable the light emitting element 500 to emit light.

In the embodiments of the present disclosure, the second light emission control circuit 800 is provided so as to allow the light emitting element 500 to emit light only in the light emitting stage, avoiding a phenomena that the light emitting element 500 generates weak light in a non-light emitting stage (e.g., the compensation stage and the data writing stage), so that a contrast of a display device adopting the pixel circuit is increased and the display effect is improved.

It should be noted that the first voltage VSS in the embodiments of the present disclosure is exemplarily input continuously with a direct-current low-level signal and the direct-current low-level is named as the first voltage; the second voltage VDD in the embodiments of the present disclosure is exemplarily input continuously with a direct-current high-level signal and the direct-current high-level is named as the second voltage. Cases in below embodiment are same and not repeated any more.

Figure 5:
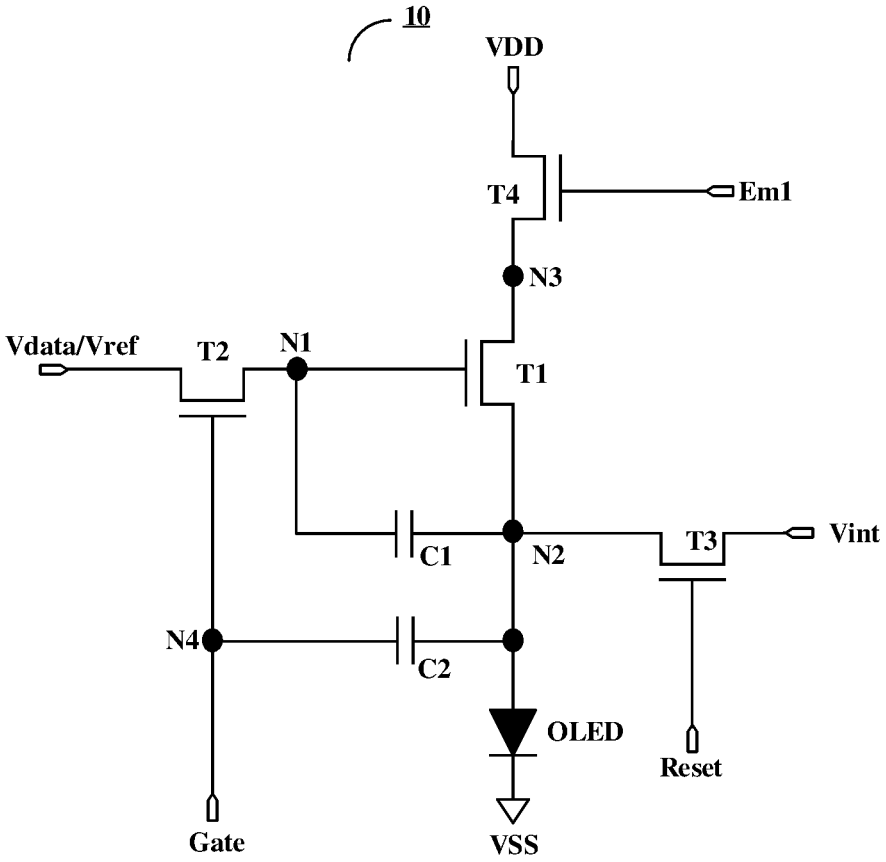
FIG. 5 is a circuit diagram showing a specific implemental example of the pixel circuit as illustrated in FIG. 3.

For example, the pixel circuit 10 as illustrated in FIG. 3 may be implemented as a circuit structure as illustrated in FIG. 5. As illustrated in FIG. 5, the pixel circuit 10 includes first to fourth transistors T1, T2, T3, T4 and first and second storage capacitors C1, C2 and a light emitting element OLED. For example, the first transistor T1 is used as a driving transistor, and other second to fourth transistors are used as switch transistors. For example, the light emitting element OLED may be in a variety of types, such as top-emission type, bottom-emission type and the like, and may emit red light, green light, blue light or white light or the like, which is not limited by the embodiments of the present disclosure.

For example, as illustrated in FIG. 5, more specifically, the driving circuit 100 may be implements as the first transistor T1. A gate electrode of the first transistor T1 functions as the control terminal 130 of the driving circuit 100 and is connected with the first node N1, a first electrode of the first transistor T1 functions as the first terminal 110 of the driving circuit 100 and is connected with the third node N3, and a second electrode of the first transistor T1 functions as the second terminal 120 of the driving circuit 100 and is connected with the second node N2.

The data writing circuit may be implemented as the second transistor T2. A gate electrode of the second transistor T2 is configured to be connected with the scan signal terminal Gate to receive the scan signal, a first electrode of the second transistor T2 is configured to be connected with the data signal terminal Vdata/Vref to receive the data signal Vdata or the reference voltage signal Vref, and a second electrode of the second transistor T2 is connected with the first node N1.

The first compensation circuit 300 may be implemented as the first storage capacitor C1. A first electrode of the first storage capacitor C1 is connected with the first node N1, and a second electrode of the first storage capacitor C1 is connected with the second node N2.

The second compensation circuit 400 may be implemented as the second storage capacitor C2. A first electrode of the second storage capacitor C2 is connected with the scan signal terminal Gate, and a second electrode of the second storage capacitor C2 is connected with the second node N2.

The reset circuit 600 may be implemented as the third transistor T3. A gate electrode of the third transistor T3 is configured to be connected with the reset terminal Reset to receive the reset signal, a first electrode of the third transistor T3 is connected with the second node N2, and a second electrode of the third transistor T3 is configured to be connected with the reset voltage Vint to receive the reset voltage.

The first light emission control circuit 700 may be implemented as the fourth transistor T4. A gate electrode of the fourth transistor T4 is configured to be connected with the first light emission control terminal Em1 to receive the first light emission control signal, a first electrode of the fourth transistor T4 is configured to be connected with the second voltage terminal VDD to receive the second voltage, and a second electrode of the fourth transistor T4 is configured to be connected with the first terminal 110 (i. e. the third node N3) of the driving circuit 100.

Figure 6:
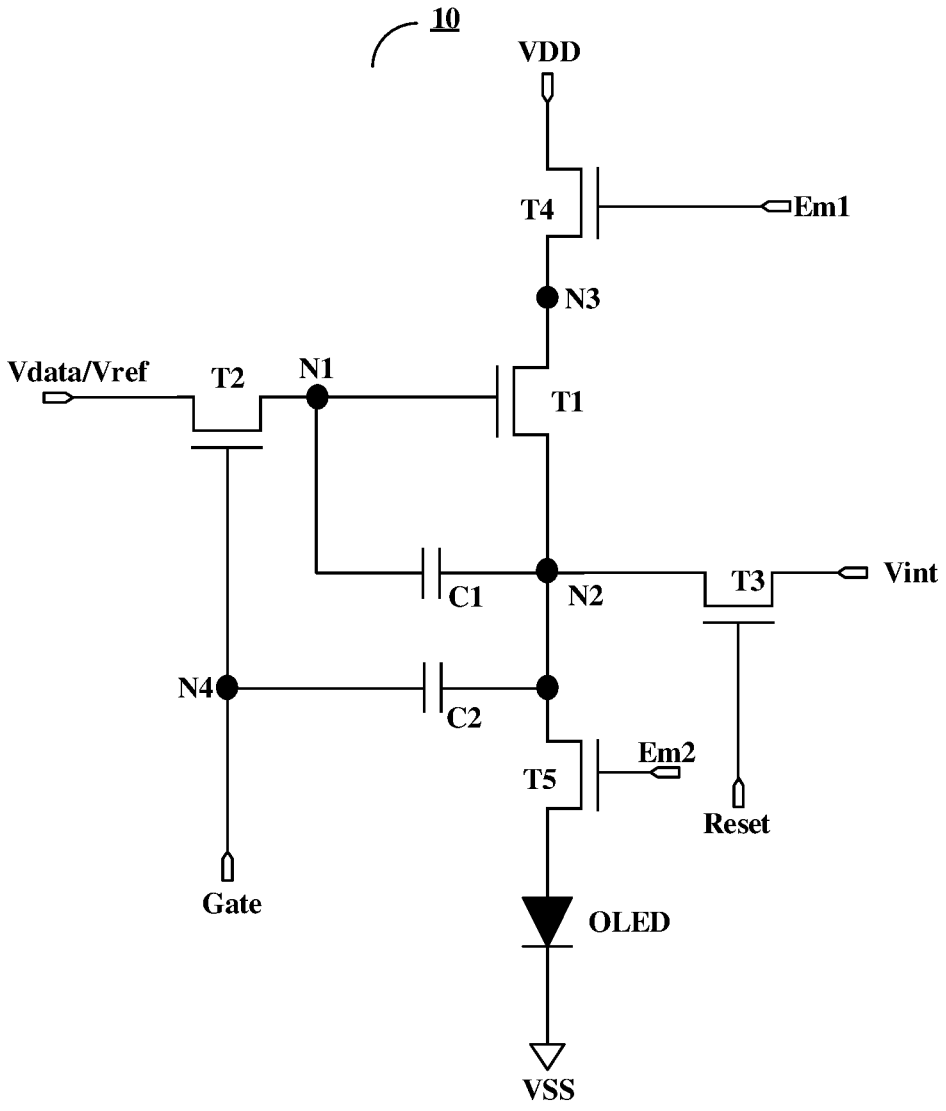
FIG. 6 is a circuit diagram showing a specific implemental example of the pixel circuit as illustrated in FIG. 4.

In an embodiment of the present disclosure, the pixel circuit 10 as illustrated in FIG. 4 may be implemented as a circuit structure as illustrated in FIG. 6. As illustrated in FIG. 6, the pixel circuit 10 includes first to fifth transistors T1, T2, T3, T4, T5 and first and second storage capacitors C1, C2 and a light emitting element OLED. For example, the first transistor T1 is used as a driving transistor, and other second to fifth transistors are used as switch transistors.

For example, as illustrated in FIG. 6, the second light emission control circuit 800 may be specifically implemented as the fifth transistor T5. A gate electrode of the fifth transistor T5 is configured to be connected with the second light emission control terminal Em2 to receive the second light emission control signal, a first electrode of the fifth transistor T5 is connected with the second node N2, and a second electrode of the fifth transistor T5 is connected with the light emitting element OLED (e. g. an anode of the light emitting element OLED). It should be noted that descriptions about other transistors and storage capacitors in FIG. 6 can be referred to corresponding descriptions about the pixel circuit 10 as illustrated in FIG. 5, which is not repeated here.

In description about the embodiments of the present disclosure, the first node N1, the second node N2, the third node N3 and the fourth node N4 are not really existed components, but for indicating junctions of electrical connection in circuit diagrams.

Figure 7:
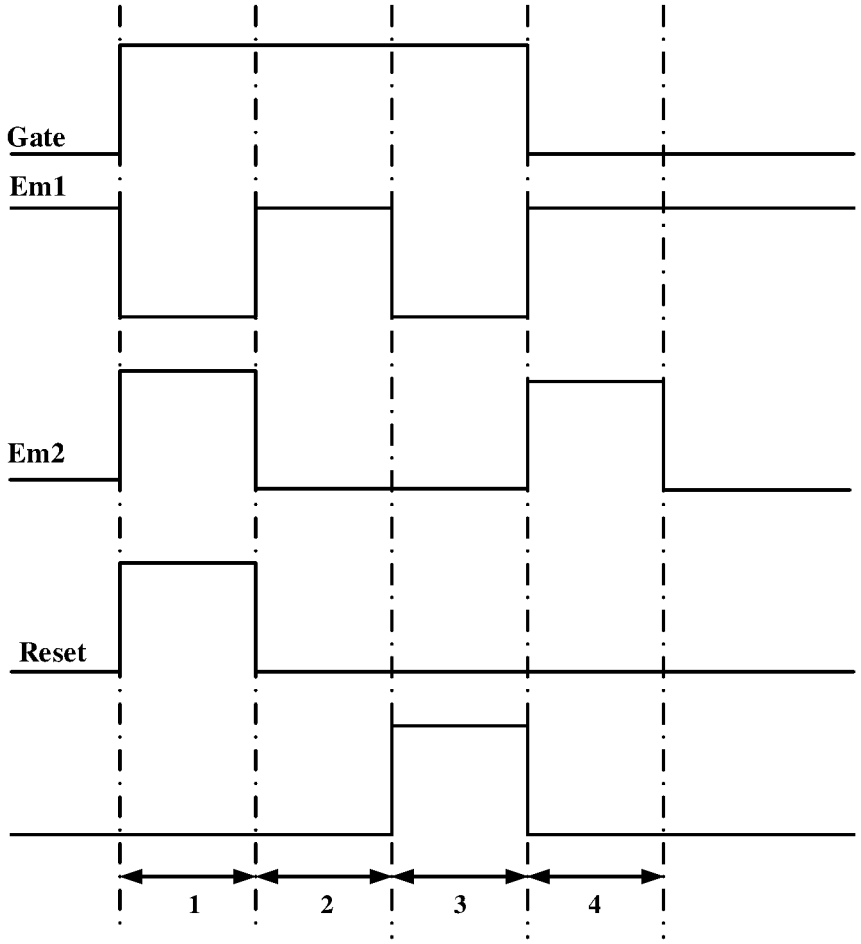
FIG. 7 is a timing diagram of a driving method provided by an embodiment of the present disclosure.

An operation principle of the pixel circuit 10 as illustrated in FIG. 5 is described below in combination with a timing diagram illustrated in FIG. 7, and taking each transistor as an n-type transistor for example. However, the embodiments of the present disclosure are not limited thereto. As illustrated in FIG. 7, four stages are included, that is, a reset stage 1, a compensation stage 2, a data writing stage 3 and a light emitting stage 4. Timing waveforms of each signal in each stage are illustrated in the figure.

Figure 8:
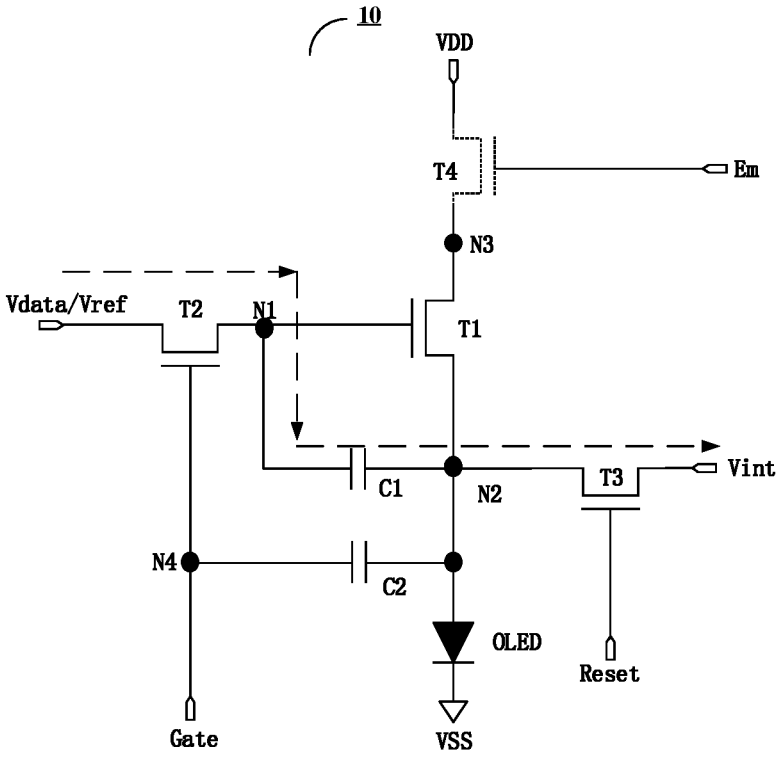
FIG. 8 to FIG. 11 are respectively circuit diagrams of the pixel circuit as illustrated in FIG. 5 corresponding to four stages in FIG. 7.
Figure 9:
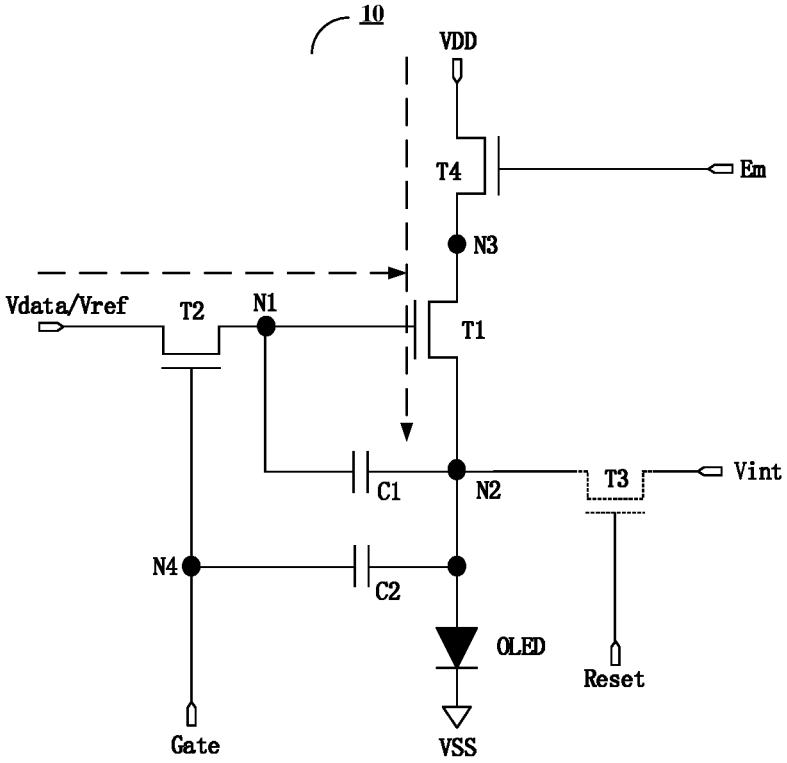
Figure 10:
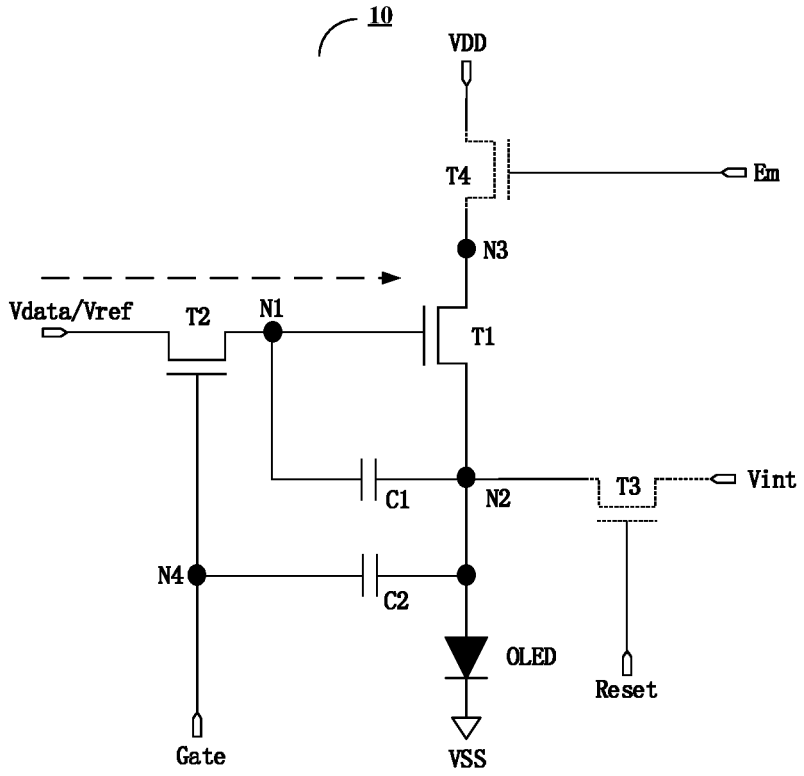
Figure 11:
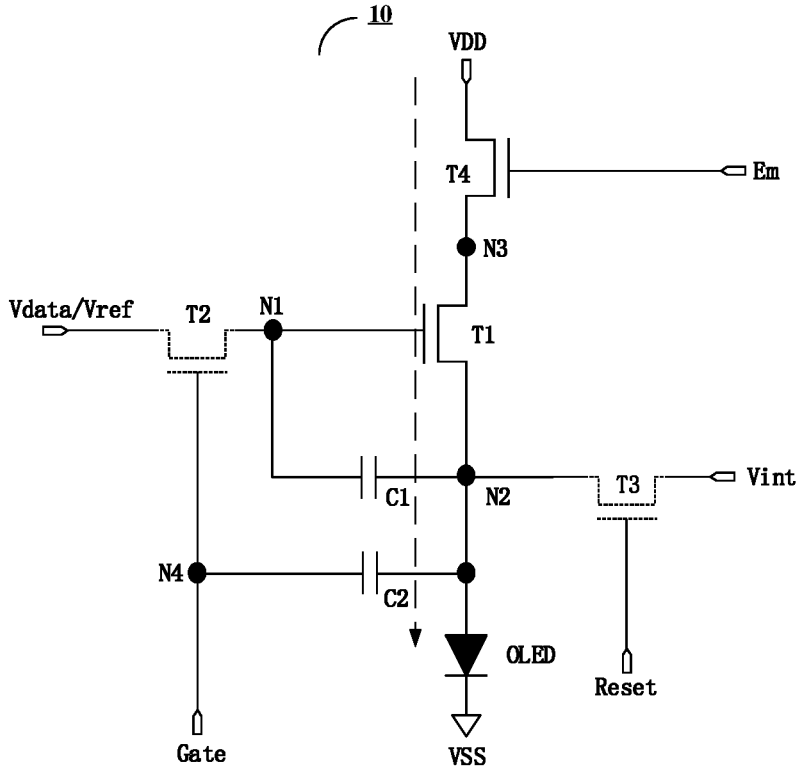

It should be noted that FIG. 8 is a schematic diagram of the pixel circuit 10 as illustrated in FIG. 5 during the reset stage 1, FIG. 9 is a schematic diagram of the pixel circuit 10 as illustrated in FIG. 5 during the compensation stage 2, FIG. 10 is a schematic diagram of the pixel circuit 10 as illustrated in FIG. 5 during the data writing stage 3, and FIG. 11 is a schematic diagram of the pixel circuit 10 as illustrated in FIG. 5 during the light emitting stage 4. Additionally, transistors in FIG. 8 to FIG. 11 indicated with dashed lines are meant to be in a turned-off state during the corresponding stages, and dashed lines with an arrow in FIG. 8 to FIG. 11 indicate a current direction of the pixel circuit during the corresponding stages. Transistors in FIG. 8 to FIG. 11 are described in an example of n-type transistor, that is, each transistor is turned on in a case that a gate electrode is input with a high level and is turned off in a case that a gate electrode is input with a low level.

During the reset stage 1, a rest signal and a scan signal are input, the reset circuit 600 and the data writing circuit 200 are turned on, and the first compensation circuit 300, the second compensation 400 and the light emitting element 500 are reset.

As illustrated in FIG. 7 and FIG. 8, during the reset stage 1, the third transistor T3 is turned on by a high level of the reset signal, and the second transistor T2 is turned on by a high level of the scan signal. Meanwhile, the fourth transistor T4 is turned off by a low level of a first light emission control signal, so no current is running through the first transistor T1.

As illustrated in FIG. 8, during the reset stage 1, a reset path (as indicated by the dashed line with an arrow in FIG. 8) is formed. The first storage capacitor C1, the second storage capacitor C2 and the light emitting element OLED discharge through the third transistor T3 so as to reset the second node N2, so a potential of the second node N2 after the reset stage 1 is the reset voltage, for example, the reset voltage is about −3V. During the reset stage, a reference voltage signal Vref is input from the data signal terminal Vdata/Vref, so a potential of the first node N1 after the reset stage 1 is a level of the reference voltage signal Vref, for example, the level of the reference voltage signal Vref is about 3V. In this situation, the first transistor T1 is turned on due to the reference voltage signal which is applied to the gate electrode of the first transistor T1.

During the reset stage 1, the first storage capacitor C1 is reset so as to allow the voltage stored in the first storage capacitor C1 to discharge and allow data signals in subsequent stages to be stored in the first storage capacitor C1 more rapidly and reliably. Meanwhile, the second node N2 is reset, that is, the light emitting element OLED is reset, so as to enable the light emitting element OLED to be in a dark state without emitting light before the light emitting stage 4. Display effects such as contrast ratio of the display device adopting the above pixel circuit are improved.

It should be noted that, exemplarily as illustrated in FIG. 6 and FIG. 7, in a condition that the pixel circuit 10 includes the second light emission control circuit 800 (exemplarily implemented as a fifth transistor T5), during the reset stage 1, the fifth transistor T5 is turned on by a high level of a second light emission control signal (provided by the second light emission control terminal Em2), so that the light emitting element OLED can also be reset.

During the compensation stage 2, the scan signal and a first light emission control signal are input, the data writing circuit 200, the first light emission control circuit 700 and the driving circuit 100 are turned on, and the driving circuit 100 is compensated by the first compensation circuit 300.

As illustrated in FIG. 7 and FIG. 9, during the compensation stage 2, the fourth transistor T4 is turned on by a high level of the first light emission control signal, the second transistor T2 is turned on by a high level of the scan signal. Because the second transistor T2 is turned on, the reference voltage signal Vref is input to the first node N1 from the data signal terminal Vdata/Vref, so that the first transistor T1 is turned on by the high level of the reference voltage signal Vref. Meanwhile, the third transistor T3 is turned off by a low level of the reset signal.

As illustrated in FIG. 9, during the compensation stage 2, a compensation path (as indicated by the dashed line with an arrow in FIG. 9) is formed, and the second node N2 is charged (i.e. the first storage capacitor C1 is charged) through the fourth transistor T4 and the first transistor T1 by the second voltage provided by the second voltage terminal VDD. It is easily understood that during the compensation stage, the potential of the first node N1 maintains at the level Vref of the reference voltage signal. Meanwhile, according to a property of the first transistor T1 itself, when the penitential of the second node N2 is increased to Vref-Vth, the first transistor T1 is turned off and the charging process ends. It should be noted that Vth indicates a threshold voltage of the first transistor T1. Because the first transistor T1 is described taking an n-type transistor as an example in this embodiment, the threshold voltage Vth here is a positive value.

The level Vref of the reference voltage signal may be selected according to the threshold voltage Vth of the first transistor T1 so as to allow a turn-on time of the first transistor T1 during the compensation stage 2 to be short and allow the current running through the first transistor T1 during the compensation stage 2 to be small, so that the light emitting element OLED is prevented from emitting light.

After the compensation stage 2, the potential of the first node N1 maintains at the level Vref of the reference voltage signal and the potential of the second node N2 is Vref-Vth, that is, voltage information including the threshold voltage Vth is stored in the first storage capacitor C1 so as to be used to compensate the threshold voltage of the first transistor T1 itself during the subsequent light emitting stage.

It should be noted that, exemplarily as illustrated in FIG. 6 and FIG. 7, in a condition that the pixel circuit 10 includes the second light emission control circuit 800 (exemplarily implemented as a fifth transistor T5), during the compensation stage 2, the fifth transistor T5 is turned off by a low level of the second light emission control signal (provided by the second light emission control terminal Em2), so as to avoid a phenomena that the light emitting element OLED may generate weak light during the compensation stage 2, so that the contrast of the display device adopting the pixel circuit 10 is increased and display effect is improved.

During the data writing stage 3, the scan signal and a data signal are input, the data writing circuit 200 is turned on, the data signal is written in the first compensation circuit 300 by the data writing circuit 200, and the voltage of the second node N2 is adjusted, by coupling, by the second compensation circuit 400 according to the voltage variation value at the first node N1.

As illustrated in FIG. 7 and FIG. 10, during the data writing stage 3, the second transistor T2 is turned on by a high level of the scan signal; meanwhile, the third transistor T3 is turned off by a low level of the reset control signal, and the fourth transistor T4 is turned off by a low level of the first light emission control signal.

As illustrated in FIG. 10, during the data writing stage 3, a data writing path (as indicated by the dashed line with an arrow in FIG. 10) is formed, and the first node N1 is charged by the data signal Vdata through the second transistor T2, so that the potential of the first node N1 changes from the level Vref of the reference voltage signal to the level Vdata of the data signal. Because of a property of a capacitor itself, a potential variation of one terminal of the first storage capacitor C1, that is the first node N1, can cause a variation of the other terminal of the capacitor, that is, the second node N2. Meanwhile, according to a series connection of the first storage capacitor C1 and the second storage capacitor C2 and an unchanged potential of a terminal (i.e. the fourth node N4) of the second storage capacitor C2, the potential of the second node N2 can be obtained as Vref−Vth+(Vdata−Vref) C1/(C1+C2) according to the charge conservation principle.

After the data writing stage 3, the potential of the first node N1 is the level Vdata of the data signal and the potential of the second node N2 is Vref−Vth+(Vdata−Vref) C1/(C1+C2), that is, voltage information including the data signal Vdata is stored in the first storage capacitor C1, so as to be used to provide a greyscale display data during the subsequent light emitting stage.

It should be noted that, exemplarily as illustrated in FIG. 6 and FIG. 7, in a condition that the pixel circuit 10 includes the second light emission control circuit 800 (exemplarily implemented as the fifth transistor T5), during the data writing stage 3, the fifth transistor T5 is turned off by a low level of the second light emission control signal (provided by the second light emission control terminal Em2), so as to avoid a phenomena that the light emitting element OLED may generate weak light during the data writing stage 3, so that the contrast of the display device adopting the pixel circuit 10 is increased and display effect is improved.

During the light emitting stage 4, the first light emission control signal is input, the first light emission control circuit 700 and the driving circuit 100 are turned on, the voltage of the second node N2 is adjusted, by coupling, by the second compensation circuit 400 according to the voltage variation of the first node N1, and the driving current is applied to the light emitting element 500 by the first light emission control circuit 700 to drive the light emitting element 500 to emit light.

As illustrated in FIG. 7 and FIG. 11, during the light emitting stage 4, the fourth transistor T4 is turned on by a high level of the first light emission control signal, and the first transistor T1 continues to be turned on because of the level of the first node N1 during the last stage. Meanwhile, the second transistor T2 is turned off by a low level of the scan signal, and the third transistor T3 is turned off by a low level of the rest signal.

As illustrated in FIG. 11, during the light emitting stage 4, a driving light emitting path (as indicated by the dashed line with an arrow in the FIG. 11) is formed. The light emitting element OLED can emit light under action of the driving current running through the first transistor T1. As illustrated in FIG. 7, from the data writing stage 3 to the light emitting stage 4, the level of the scan signal (i.e. a level of the fourth node N4) changes from a high level Vgate(High) to a low level Vgate(Low). In this situation, deeming the first storage capacitor C1 and the second storage capacitor C2 in series as one capacitor, the level variation of the fourth node N4 can cause the level variation of the first node N1. Thus, during this stage, the potential of the first node N1 changes to Vgate(Low)−Vgate(High)+Vdata. During the light emitting stage 4, the potential of the fourth node N4 maintains at Vgate (Low), unchanged. Similarly, a method same as during the data writing stage 3 is adopted and the potential of the second node N2 can be obtained as Vgate(Low)−Vgate(High)−Vgate(Low)*C2/(C1+C2)+Vref−Vth+(Vdata−Vref)*C1/(C1+C2).

It should be noted that in the embodiments of the present disclosure, Vgate(Low) indicates a level of the scan signal at a low potential, for example, Vgate(Low) may include −5V, and Vgate(High) indicates a level of the scan signal at a high potential, for example, Vgate(High) may include 5V.

Specifically, the driving current $I_{OLED}$ running through the light emitting element OLED may be obtained according to the following formula:

$$I_{OLED}=\frac{1}{2}*K*(Vgs-Vth)^2$$

Substituting the following values:

$$Vg=V_{N1}=V\text{gate(Low)}-V\text{gate(High)}+V\text{data},$$

$$Vs=V_{N2}=V\text{gate(Low)}-V\text{gate(High)}-V\text{gate(Low)}*C2/(C1+C2)+V\text{ref}-Vth+(V\text{data}-V\text{ref})*C1/(C1+C2)$$

into the above formula and it can be obtained that:

$$I_{OLED}=\tfrac{1}{2}*K*(V\text{gate(Low)}*C2/(C1+C2)+(V\text{data}-V\text{ref})*C2/(C1+C2))^2.$$

In the above formula, Vth indicates the threshold voltage of the first transistor T1, Vgs indicates the voltage between the gate electrode of the first transistor T1 and the first electrode (e.g., a source electrode) of the first transistor T1, $V_{N1}$ indicates the potential of the first node N1, $V_{N2}$ indicates the potential of the second node N2, and K is a constant. As can be seen from the above formula, the driving current $I_{OLED}$ running through the light emitting element OLED is no longer relevant to the threshold voltage Vth of the first transistor T1, so that a compensation to the pixel circuit is realized, a threshold voltage drifting problem of the driving transistor (the first transistor T1 in the embodiments of the present disclosure) caused by the process and a long operation is solved and an influence on the driving current $I_{OLED}$ caused by the problem is eliminated. Thus, display effect is improved.

It should be noted that, exemplarily as illustrated in FIG. 6 and FIG. 7, in a condition that the pixel circuit 10 includes the second light emission control circuit 800 (exemplarily implemented as the fifth transistor T5), during the light emitting stage 4, the fifth transistor T5 is turned on by a high level of the second light emission control signal (provided by the second light emission control terminal Em2), so as to apply the driving current $I_{OLED}$ to the light emitting element OLED to enable it to emit light.

It should be noted that transistors adopted in the embodiments of the present disclosure all may be thin film transistors, field-effect transistors or other switching devices with same characteristics and thin film transistors are taken as an example to illustrated in the embodiments of the present disclosure. Source electrodes and drain electrodes of the transistors adopted herein may be symmetric in structure, so the source electrodes and drain electrodes are not different structurally. In the embodiments of the present disclosure, in order to distinguish the two electrodes apart from the gate electrode, one electrode is described as a first electrode and the other electrode is described as a second electrode.

Additionally, it should be noted that transistors in the pixel circuits 10 as illustrated in FIG. 5 and FIG. 6 are all described taking n-type transistors as an example. In this situation, the first electrode may be a drain electrode and the second electrode may be a source electrode. As illustrated in FIG. 5 and FIG. 6, a cathode of the light emitting element OLED of the pixel circuit 10 is connected with the first voltage terminal VSS to receive the first voltage. For example, in a display device, in a case that the pixel circuits 10 in FIG. 5 and FIG. 6 are arranged in an array, the cathodes of the light emitting elements OLEDs may be connected with a same voltage terminal, that is, a common-cathode connecting manner is adopted.

Figure 12:
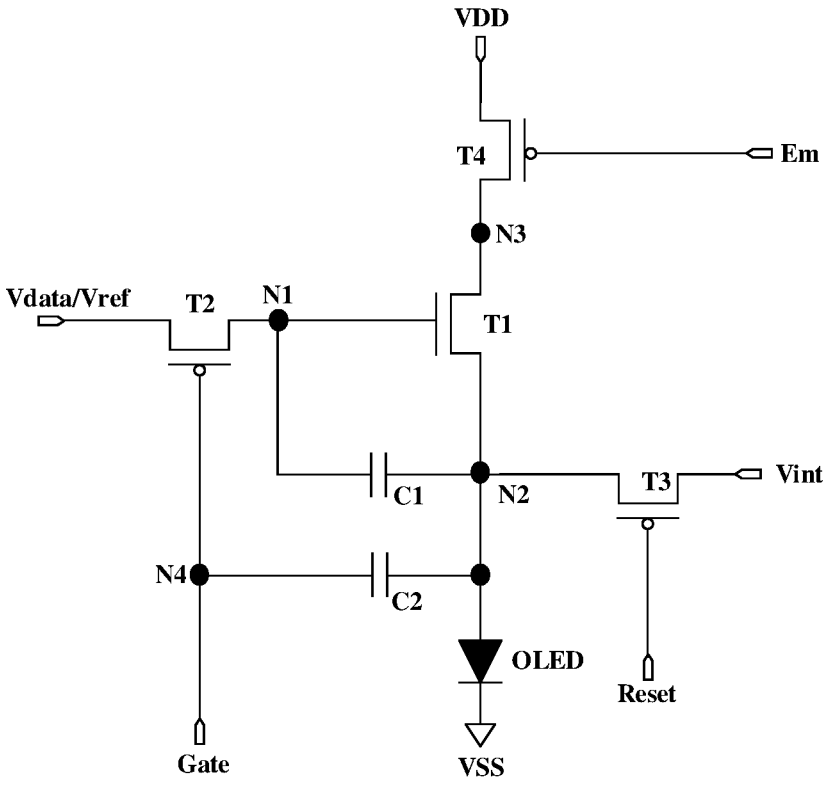
FIG. 12 is a circuit diagram of a pixel circuit provided by an embodiment of the present disclosure.

Configuration manner as illustrated in FIG. 5 and FIG. 6 are included by but not limited to the embodiments of the present disclosure. For example, as illustrated in FIG. 12, in another embodiment of the present disclosure, transistors in pixel circuit 10 may also adopt a hybrid of p-type transistors and n-type transistors, and it is only needed to connect the terminal of the transistor in the selected type with a polarity according to a terminal polarity of the corresponding transistor in the embodiments of the present disclosure. For example, as illustrated in FIG. 12, the first transistor T1 adopts an n-type transistor, and the second transistor T2, the third transistor T3 and the fourth transistor T4 all adopt a p-type transistor. It should be noted that signal levels provided to the second transistor T2, the third transistor T3 and the fourth transistor T4 need to be changed to low levels accordingly.

It should be noted in the embodiments of the present disclosure, in a case that the driving transistor, i.e. the first transistor T1, adopts an n-type transistor, it may be manufactured by adopting an IGZO (Indium Gallium Zinc Oxide) manufacturing process. Compared to adopting a LTPS (Low Temperature Poly Silicon) manufacturing process, the size of the driving transistor can be effectively reduced.

Figure 13:
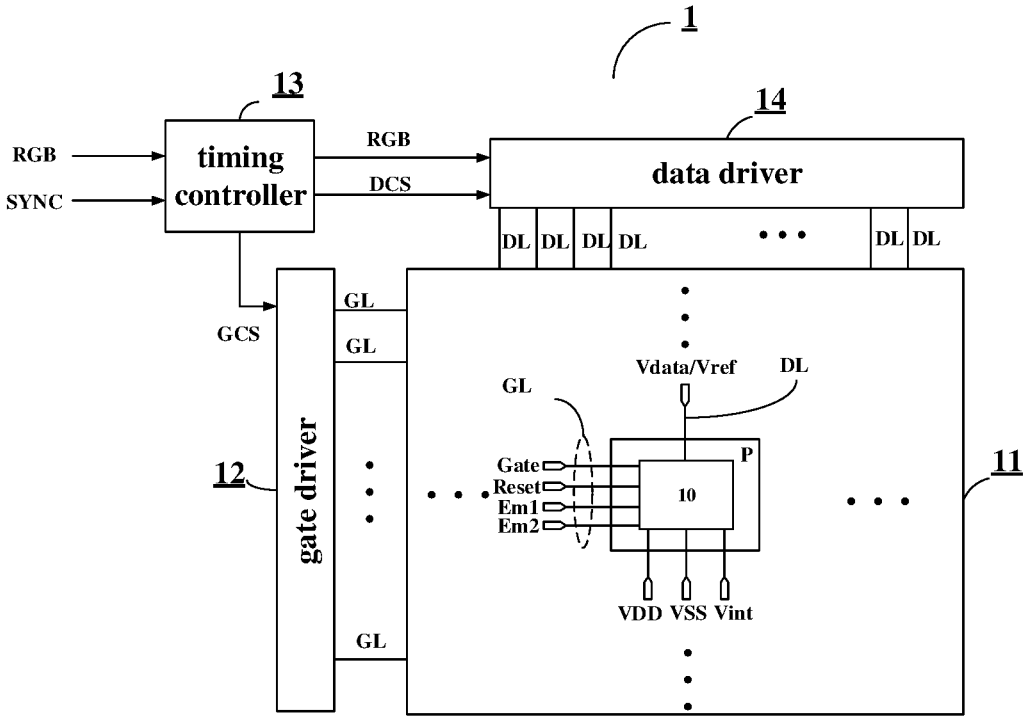
FIG. 13 is a schematic diagram of a display device provided by an embodiment of the present disclosure.

Embodiments of the present disclosure further provide a display device 1. As illustrated in FIG. 13, the display device 1 includes a plurality of pixel units P arranged in an array, a plurality of scan control lines GL and a plurality of data signal lines DL. It should be noted that FIG. 13 only illustrates a part of the pixel units P, the scan control lines GL and the data signal lines DL. For example, each pixel unit P includes any one of the pixel circuits 10 provided by the above embodiments, for example, the pixel circuit 10 as illustrated in FIG. 5 or FIG. 6.

For example, the scan signal line at each row is connected with the data writing circuit 200 (i.e. the scan signal terminal Gate) and the second compensation circuit 400 of the pixel circuit 10 at the each row so as to provide the scan signal; and the data signal line DL at each column is connected with the data writing circuit 200 (i.e. the data signal terminal Vdata/Vref) at the each column so as to provide the data signal Vdata or the reference voltage signal Vref.

For example, in a condition that the pixel circuit 10 includes the reset circuit 600 and the first light emission control circuit 700, the display device 1 further includes a plurality of reset control lines and a plurality of first light emission control lines.

For example, the reset circuit 600 is connected with the reset control terminal Reset, the reset voltage terminal Vint and the second terminal 120 of the driving circuit 100, and is configured to apply the reset voltage to the second terminal 120 of the driving circuit 100 in response to the reset signal. For example, the reset control line at each row is connected with the reset control terminal Reset (i.e. connected with the reset circuit 600) of the pixel circuit at the each row so as to provide the reset signal.

For example, the first light emission control circuit 700 is connected with the second voltage terminal VDD, the first light emission control terminal Em1 and the first terminal 110 of the driving circuit 100, and is configured to apply the second voltage to the first terminal 110 of the driving circuit 100 in response to the first light emission control signal. For example, the first light emission control line at each row is connected with the first light emission control terminal Em1 (i.e. connected with the first light emission control circuit 700) at the each row so as to provide the first light emission control signal.

For example, in a condition that the pixel circuit 10 includes the second light emission control circuit 800, the display device 1 may further include a plurality of second light emission control lines.

For example, the second light emission control circuit 800 is connected with the second light emission control terminal Em2, the second node N2 and the light emitting element 500, and is configured to apply the driving current to the light emitting element 500 in response to the second light emission control signal. For example, the second light emission control line at each row is connected with the second light emission control circuit 800 of the pixel circuit 10 at the each row so as to provide the second light emission control signal.

It should be noted that the display device 1 as illustrated in FIG. 13 may further include a plurality of first voltage lines, a plurality of second voltage lines and a plurality of reset voltage lines so as to respectively provide the first voltage, the second voltage and the reset voltage.

For example, as illustrated in FIG. 13, the display device may further include a display panel 11, a gate driver 12, a data driver 14 and a timing controller 13. The display panel 11 includes a plurality of pixel units P defined by intersections of a plurality of scan control lines GL and a plurality of data signal lines DL. The gate driver 12 is configured to drive the plurality of scan control lines GL, the data driver 14 is configured to drive the plurality of data signal lines DL, and the timing controller 13 is configured to arrange image data RGB input from outside the display device 1, to provide the arranged image data RGB to the data driver 14, to output scan control signals GCS to the gate driver 12, and to output data control signals DCS to the data driver 14, so as to control the gate driver 12 and the data driver 14.

As illustrated in FIG. 13, each pixel unit P is connected with a plurality of scan control lines GL (including the scan signal line, the reset control line and the first light emission control line), a data signal lien DL, a first voltage line configured to provide the first voltage, a second voltage line configured to provide the second voltage and a reset voltage line configured to provide the reset voltage. It should be noted that in a condition that the pixel circuit 10 includes the second light emission control circuit 800, each pixel circuit 10 is further connected to the second light emission control line.

For example, the gate driver 12 provide a plurality of strobe signals to the plurality of scan control lines GL according to the scan control signals GCS from the timing controller 13. The plurality of strobe signals include the scan signal, the first light emission control signal, the second light emission control signal and the reset signal. These strobe signals are provided to each pixel unit P through the plurality of scan control lines GL.

For example, the data driver 14 converts the digital image data RGB from the timing controller 13 to the data signal Vdata according to a plurality of data control signals DCS from the timing controller 13 using a reference Gamma voltage. The data driver 14 provides the converted data signals Vdata to the plurality of data signal lines DL. The data driver 14 outputs the data signal Vdata only during the data writing stage 3 (FIG. 5) of each pixel unit P, and during the stages other than the data writing stage 3, the data driver 14 provides the reference voltage signal Vref to the plurality of data signal lines DL.

For example, the timing controller 13 sets the image data RGB input from outside so as to enable it to match with the size and the resolution of the display panel 11, and then provides the set image data to the data driver 14. The timing controller 13 uses a synchronization signal (e.g., a dot clock DCLK, a data enable signal DE, a horizontal synchronizing signal Hsync and a vertical synchronizing signal Vsync) input from outside the display device to generate the plurality of scan control signals GCS and the plurality of data control signals DCS, and the timing controller 13 respectively provide the generated scan control signals GCS and data control signals DCS to the gate driver 12 and the data driver 14 for controlling the gate driver 12 and the data driver 14.

For example, the data driver 14 may be connected with the plurality of data signal lines DL so as to provide the data signal Vdata, and meanwhile be connected with a plurality of first voltage lines, a plurality of second voltage lines and a plurality of reset voltage lines to respectively provide the first voltage, the second voltage and the reset voltage.

For example, the scan driving circuit and the data driving circuit may be implemented as a semiconductor chip. The display device 1 may include other components, such as a signal decode circuit, a voltage conversion circuit and the like. These components may adopt the known conventional components, which is not described in detail.

A process of progressive scanning of the display device 1 is described below in combination with the description about the operation principle of the pixel circuit 10 as illustrated in FIG. 5 in the above embodiments, and each stage of the embodiment may be referred to the corresponding description in the above embodiments.

For example, after the reset stage, the pixel circuit at an Nth row receives the scan signal of the scan signal line and enters the compensation stage. During the compensation stage, the threshold voltage Vth of the driving transistor (T1) of the pixel circuit at the Nth row is written in the first compensation circuit, to be used to compensate the threshold voltage Vth during the subsequent light emitting stage. It is easily understood that because a control signal such as a reset signal is applied row by row according to a timing signal, the pixel circuit at a (N+1)th row is during the reset stage at this moment.

The pixel circuit at the Nth row enters the data writing stage after the compensation stage. During the data writing stage, the data signal Vdata is written in the first compensation circuit of the pixel circuit at the Nth row, to be used to provide a corresponding greyscale display data during the subsequent light emitting stage. At this moment, the pixel circuit at the (N+1)th row is during the compensation stage and a corresponding threshold voltage Vth is written in the first compensation circuit of the pixel circuit at the (N+1)th row.

The pixel circuit at the Nth row enters the light emitting stage after the data writing stage. The first light emission control circuit 700 of the pixel circuit at the Nth row is accessed to a turn-on signal provided by the first light emission control line at the Nth row and turnes on, so that the pixel circuit at the Nth row realizes a light emitting display. Meanwhile, the pixel circuit at the (N+1)th row is during the data writing stage and corresponding data signal Vdata is written in the first compensation lien of the pixel circuit at the (N+1)th row. At next moment, the first light emission control circuit 700 of the pixel circuit at the (N+1)th row is accessed to a turn-on signal provided by the first light emission control line at the (N+1)th row and turns on, so that a light emitting display is realized, and so on. Thus, a progressive scanning display is realized.

Technical effects of the display device 1 can be referred to the technical effects of the pixel circuit 10 provided by the embodiments of the present disclosure, which is not repeated here.

For example, the display device 1 may be a product or component having display functions such as an e-paper, a cellphone, a tablet computer, a television, a displayer, a notebook computer, a digital photo frame, a navigator and the like.

Embodiments of the present disclosure further provide a driving method, which may be used to drive the pixel circuit 10 provided by the embodiments of the present disclosure. For example, the driving method includes the following operations.

During the reset stage, the rest signal and the scan signal are input, the reset circuit 600 and the data writing circuit 200 are turned on, and the first compensation circuit 300, the second compensation 400 and the light emitting element 500 are reset.

During the compensation stage, the scan signal and the first light emission control signal are input, the data writing circuit 200, the first light emission control circuit 700 and the driving circuit 100 are turned on, and the driving circuit 100 is compensated by the first compensation circuit 300.

During a data writing stage, the scan signal and the data signal are input, the data writing circuit 200 is turned on, the data signal is written in the first compensation circuit 300 by the data writing circuit 200, and the voltage of the second node N2 is adjusted, by coupling, by the second compensation circuit 400 according to the voltage variation value at the first node N1.

During the light emitting stage, the first light emission control signal and the second light emission control signal are input, the first light emission control circuit 700, the second light emission control circuit 800 and the driving circuit 100 are turned on, and the voltage of the second node N2 is adjusted, by coupling, by the second compensation circuit 400 according to the voltage variation value at the first node N1. The second voltage is applied to the first terminal 110 of the driving circuit 100 by the first light emission control circuit 700, and the driving current is applied to the light emitting element 500 by the second light emission control circuit 800 to drive the light emitting element 500 to emit light.

It should be noted that detailed descriptions about the driving method may be referred to the operation principle of the pixel circuit 10 in the embodiments of the present disclosure, which is not repeated here.

The driving method provided by the embodiment can compensate the threshold voltage of the driving circuit and can avoid display mura for example, so that display effect of the display device adopting the pixel circuit can be improved.

What have been described above are only specific implementations of the present disclosure, the protection scope of the present disclosure is not limited thereto. The protection scope of the present disclosure should be based on the protection scope of the claims.

What is claimed is:

1. A pixel circuit, comprising a data writing circuit, a driving circuit, a first compensation circuit, a second compensation circuit and a light emitting element, wherein the driving circuit comprises a control terminal, a first terminal and a second terminal, and is configured to control a driving current which runs through the first terminal and the second terminal and is used to drive the light emitting element to emit light;

the data writing circuit is connected with the control terminal of the driving circuit, and is configured to write a data signal or a reference voltage signal to the control terminal of the driving circuit in response to a scan signal;

the first compensation circuit is connected with the control terminal of the driving circuit and the second terminal of the driving circuit, and is configured to store the data signal that is written in and to compensate the driving circuit; and the second compensation circuit is connected with a scan signal terminal and the second terminal of the driving circuit, and is configured to adjust, by coupling, a voltage of the second terminal of the driving circuit according to a voltage variation value at the control terminal of the driving circuit;

the second compensation circuit comprises a first storage capacitor;

a first electrode of the first storage capacitor is connected with the scan signal terminal which is configured to provide the scan signal to the data writing circuit, and a second electrode of the first storage capacitor is connected with the second terminal of the driving circuit.

2. The pixel circuit according to claim 1, wherein the control terminal of the driving circuit is connected with a first node, and the second terminal of the driving circuit is connected with a second node;

the data writing circuit is connected with the scan signal terminal, a data signal terminal and the first node; and the light emitting element is connected with the second node and a first voltage terminal.

3. The pixel circuit according to claim 2, further comprising a reset circuit, wherein the reset circuit is connected with a reset control terminal, a reset voltage terminal and the second node, and is configured to apply a reset voltage to the second node in response to a reset signal.

4. The pixel circuit according to claim 3, further comprising a first light emission control circuit, wherein the first light emission control circuit is connected with a second voltage terminal, a first light emission control terminal and the first terminal of the driving circuit, and is configured to apply a second voltage to the first terminal of the driving circuit in response to a first light emission control signal.

5. The pixel circuit according to claim 4, further comprising a second light emission control circuit, wherein the second light emission control circuit is connected with a second light emission control terminal, the second node and the light emitting element, and is configured to apply the driving current to the light emitting element in response to a second light emission control signal.

6. The pixel circuit according to claim 2, wherein the driving circuit comprises a first transistor;

a gate electrode of the first transistor functions as the control terminal of the driving circuit and is connected with the first node, a first electrode of the first transistor functions as the first terminal of the driving circuit and is connected with a third node, and a second electrode of the first transistor functions as the second terminal of the driving circuit and is connected with the second node.

7. The pixel circuit according to claim 2, wherein the data writing circuit comprises a second transistor;

a gate electrode of the second transistor is configured to be connected with the scan signal terminal so as to receive the scan signal, a first electrode of the second transistor is configured to be connected with the data signal terminal so as to receive the data signal, and a second electrode of the second transistor is connected with the first node.

8. The pixel circuit according to claim 2, wherein the first compensation circuit comprises a second storage capacitor;

a first electrode of the second storage capacitor is connected with the first node, and a second electrode of the second storage capacitor is connected with the second node.

9. The pixel circuit according to claim 3, wherein the reset circuit comprises a third transistor;

a gate electrode of the third transistor is configured to be connected with the reset control terminal so as to receive the reset signal, a first electrode of the third transistor is connected with the second node, and a second electrode of the third transistor is configured to be connected with the reset voltage terminal so as to receive the reset voltage.

10. The pixel circuit according to claim 4, wherein the first light emission control circuit comprises a fourth transistor;

a gate electrode of the fourth transistor is configured to be connected with the first light emission control terminal so as to receive the first light emission control signal, a first electrode of the fourth transistor is configured to be connected with the second voltage terminal so as to receive the second voltage, and a second electrode of the fourth transistor is connected with the first terminal of the driving circuit.

11. The pixel circuit according to claim 5, wherein the second light emission control circuit comprises a fifth transistor;

a gate electrode of the fifth transistor is configured to be connected with the second light emission control terminal so as to receive the second light emission control signal, a first electrode of the fifth transistor is connected with the second node, and a second electrode of the fifth transistor is connected with the light emitting element.

12. A display device, comprising a plurality of pixel units arranged in an array, wherein each of the plurality of pixel units comprises the pixel circuit according to claim 1.

13. The display device according to claim 12, further comprising a plurality of scan signal lines and a plurality of data signal lines, wherein a scan signal line at each row of the array is connected with the data writing circuit and the second compensation circuit of the pixel circuit at the each row of the array so as to provide the scan signal; and a data signal line at each column of the array is connected with the data writing circuit of the pixel circuit at the each column of the array so as to provide the data signal or the reference voltage signal.

14. The display device according to claim 13, further comprising a plurality of reset control lines, wherein the pixel circuit further comprises a reset circuit, and the reset circuit is connected with a reset control terminal, a reset voltage terminal and the second terminal of the driving circuit, and is configured to apply a reset voltage to the second terminal of the driving circuit in response to a reset signal; and a reset control line at each row of the array is connected with the reset circuit of the pixel circuit at the each row of the array so as to provide the reset signal.

15. The display device according to claim 14, further comprising a plurality of first light emission control lines, wherein the pixel circuit further comprises a first light emission control circuit, and the first light emission control circuit is connected with a second voltage terminal, a first light emission control terminal and the first terminal of the driving circuit, and is configured to apply a second voltage to the first terminal of the driving circuit in response to a first light emission control signal; and a first light emission control line at each row of the array is connected with the first light emission control circuit of the pixel circuit at the each row of the array so as to provide the first light emission control signal.

16. The display device according to claim 15, further comprising a plurality of second light emission control lines, wherein the pixel circuit further comprises a second light emission control circuit, and the second light emission control circuit is connected with a second light emission control terminal, the second node and the light emitting element, and is configured to apply the driving current to the light emitting element in response to a second light emission control signal; and a second light emission control line at each row of the array is connected with the second light emission control circuit of the pixel circuit at the each row of the array so as to provide the second light emission control signal.

17. A driving method of the pixel circuit according to claim 1, comprising a compensation stage and a data writing stage, wherein during the compensation stage, inputting the scan signal, turning on the data writing circuit and the driving circuit, and allowing the first compensation circuit to compensate the driving circuit; and during the data writing stage, inputting the scan signal and the data signal, turning on the data writing circuit, allowing the data writing circuit to write the data signal to the first compensation circuit, and allowing the second compensation circuit to adjust, by coupling, the voltage of the second terminal of the driving circuit according to the voltage variation value at the control terminal of the driving circuit.

18. A driving method of the pixel circuit according to claim 5, comprising a reset stage, a compensation stage, a data writing stage and a light emitting stage, wherein during the reset stage, inputting the reset signal and the scan signal, turning on the reset circuit and the data writing circuit, and resetting the first compensation circuit, the second compensation circuit and the light emitting element;

during the compensation stage, inputting the scan signal and the first light emission control signal, turning on the data writing circuit, the first light emission control circuit and the driving circuit, and allowing the first compensation circuit to compensate the driving circuit;

during the data writing stage, inputting the scan signal and the data signal, turning on the data writing circuit, allowing the data writing circuit to write the data signal to the first compensation circuit, and allowing the second compensation circuit to adjust, by coupling, a voltage of the second node according to a voltage variation value at the first node; and during the light emitting stage, inputting the first light emission control signal and the second light emission control signal, turning on the first light emission control circuit, the second light emission control circuit and the driving circuit, allowing the second compensation circuit to adjust, by coupling, the voltage of the second node according to the voltage variation value at the first node, allowing the first light emission control circuit to apply the second voltage to the first terminal of the driving circuit, and allowing the second light emission control circuit to apply the driving current to the light emitting element so as to enable the light emitting element to emit light.

19. The pixel circuit according to claim 9, wherein the data writing circuit is configured to write the data signal or the reference voltage signal to the control terminal of the driving circuit in response to a first level of the scan signal; and the first compensation circuit is configured to adjust a voltage at the control terminal of the driving circuit in response to a second level, which is different from the first level, of the scan signal from the scan signal terminal, so as to adjust, by coupling, the voltage of the second terminal of the driving circuit according to a voltage variation value at the control terminal of the driving circuit.

* * * * *